US005893199A

United States Patent [19]

Anscher

[11] Patent Number: 5,893,199

[45] Date of Patent: Apr. 13, 1999

[54] BUCKLE WITH WEBBING GRIPPING DEVICE

[75] Inventor: Joseph Anscher, Muttontown, N.Y.

[73] Assignee: National Molding Corp., Farmingdale, N.Y.

[21] Appl. No.: 09/070,987

[22] Filed: May 1, 1998

[51] Int. Cl.[6] ..... A44B 11/25

[52] U.S. Cl. ..... 24/625; 24/170

[58] Field of Search ..... 24/614–616, 625, 24/170, 191, 193

[56] References Cited

U.S. PATENT DOCUMENTS

| | | | |
|---|---|---|---|
| 4,567,628 | 2/1986 | Prete, Jr. et al. . | |
| 4,800,629 | 1/1989 | Ikeda | 24/170 |
| 5,181,280 | 1/1993 | Zachry, Jr. | 24/170 X |
| 5,561,891 | 10/1996 | Hsieh | 24/616 X |
| 5,651,166 | 7/1997 | Lundstedt . | |

*Primary Examiner*—James R. Brittain
*Attorney, Agent, or Firm*—Collard & Roe, P.C.

[57] ABSTRACT

A buckle having a device for gripping a length of webbing, comprising a buckle body formed from two side arms connected by an end arm. A locking device is connected to the ends of the side arms. A first transverse bar is mounted between the two side arms. A second transverse bar having a gripping surface is mounted between the first transverse bar and the end arm, and is vertically offset from the first transverse bar. A gripping cam is pivotally mounted between the two side arms and in between the transverse bars. The gripping cam has a gripping surface that contacts the second transverse bar and an opposite free end. A length of webbing threaded between the second transverse bar is securely held between the gripping surfaces of the transverse bar and gripping cam until the free end of the cam is pressed downward. If the cam breaks, the webbing is still held in place by the two transverse bars.

10 Claims, 5 Drawing Sheets

BUCKLE WITH WEBBING GRIPPING DEVICE

BACKGROUND OF THE INVENTION

1. Field of the Invention

This invention relates to a buckle having a webbing gripping device. In particular, the invention relates to a buckle or other device having a gripping cam that grips a strap or length of webbing and prevents the it from slipping.

2. The Prior Art

Many types of buckles are used to secure two ends of a strap or length of webbing together, typically for use as safety belts, or in luggage or outerwear. Typically, these buckles have a series of transverse arms through which the strap is threaded. These arms allow the webbing to be adjusted to fit the size of the user. When tension is applied by the strap, the strap tends to stay in place due to the friction of the strap against itself and the buckle. However, if the tension is applied perpendicular to the buckle, the friction on the strap is reduced and it can easily slide out of the buckle.

This phenomenon occurs frequently when the buckle is used as a child restraining belt in such places as high chairs. Because an infant has a very small circumference, the angle at which the tension is applied to the buckle is rarely near 180°, and can often approach 90°. At this point, the strap can easily slide out of the buckle and the belt is rendered ineffectual. Agitated motion by the infant while strapped into the belt can further increase the risk of slippage.

Accordingly, there have been efforts to provide a device that securely grips the strap or webbing under tension from all angles. One such device is shown in U.S. Pat. No. 5,651,166 to Lundstedt. This device has a flexible projecting member that rests against a transverse member of the buckle. The webbing is threaded in between the projecting member and the transverse member, and the tension from the projecting member keeps the webbing in place. This device has the disadvantage that once the webbing is sufficiently tightened, it cannot be easily loosened from the buckle to enlarge the belt.

U.S. Pat. No. 4,567,628 to Prete, Jr. et al. shows a buckle assembly having a webbing gripping device in the form of a cam member that firmly holds the webbing against the buckle. This device is useful as long as the cam member is functional. However, due to the tensioned arrangement of the cam member, there is a great risk that the cam member may break during use, causing the webbing to be completely released from the buckle.

Another device produced by Yoshida Kogyo K.K. (YKK) utilizes a pivoting grooved arm that grips the webbing as it is pulled tight against the buckle. The arm is a separate piece that is loosely held between the two sides of the buckle. While this device is easily adjustable, the webbing can easily slip out of the buckle if the tension is applied perpendicular to the buckle, as described above.

SUMMARY OF THE INVENTION

It is therefore an object of the present invention to provide a buckle assembly having a device for gripping webbing that prevents slippage of the webbing even under tension from any angle.

It is another object of the present invention to provide a buckle assembly having a device for gripping webbing that allows the webbing to be easily lengthened.

It is yet another object of the present invention to provide a buckle assembly that will not be rendered useless if the gripping device fails.

It is another object of the present invention to provide a buckle assembly having a device for gripping webbing that is simple and economical to manufacture.

These and other objects of the invention are accomplished by a buckle with a device for gripping a length of webbing, comprising a buckle body formed from two side arms and an end arm. The side arms each have an end that is connected to either the male or female locking portions of a plug and socket type buckle. The buckle can be either a center push or side release type buckle. Other types of buckles and fasteners could also be used.

A first transverse bar is mounted between the two side arms at the locking end of the buckle body. The first transverse bar is disposed near the bottom surface of the buckle body.

A second transverse bar is mounted between the two side arms and in between the first transverse bar and the end arm. The second transverse bar may have a gripping surface for increasing the friction on a length of webbing threaded through the device. This second transverse bar is offset from the first transverse bar both vertically and horizontally, to accommodate and retain a length of webbing threaded therethrough.

A gripping cam is pivotally mounted between the two side arms and in between the first and second transverse bars. The cam has a gripping surface contacting the second transverse bar, to trap the webbing between the cam and second transverse bar.

The free end of the cam opposite the gripping surface extends above the upper surface of the buckle body. In its resting position, the cam is forced against the second transverse bar to securely grip the webbing. The webbing can be released by pressing downward on the free end of the cam.

In a first embodiment, the cam is made of a resilient material that allows it to be bent between the gripping position and the release position. The cam is pivotally mounted to the sides of the buckle body with lugs that extend through apertures in the buckle body. The cam has a downwardly and rearwardly extending flange on its bottom surface that rests on the top of the first transverse bar and provides the necessary tension to keep the cam in the gripping position. Pressing downward on the end of the cam pivots the cam away from the second transverse bar.

In a second embodiment, the first transverse bar is spaced apart from the locking portion of the buckle and more toward the second transverse bar. The first transverse bar has an upwardly and rearwardly extending resilient flange that contacts the underside of the cam near its free end opposite the gripping surface. Unlike the first embodiment, the gripping cam does not have the lower flange and does not bend. Instead, the flange on the first transverse bar bends in response to downward pressure on by the cam to release the webbing. In this embodiment, the cam is also pivotally connected to the side arms of the buckle body.

The device can be made out of any suitable material, such as acetal or nylon.

The gripping surface comprises a plurality of teeth on the gripping cam. The gripping surface contacts the webbing and holds the webbing in place via friction from the teeth and downward pressure from the gripping cam on the second transverse bar. Alternatively, the gripping surfaces could contain grooves or be textured to create friction with the webbing. In addition, the second transverse bar could also contain a toothed, grooved or textured gripping surface to add additional friction.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
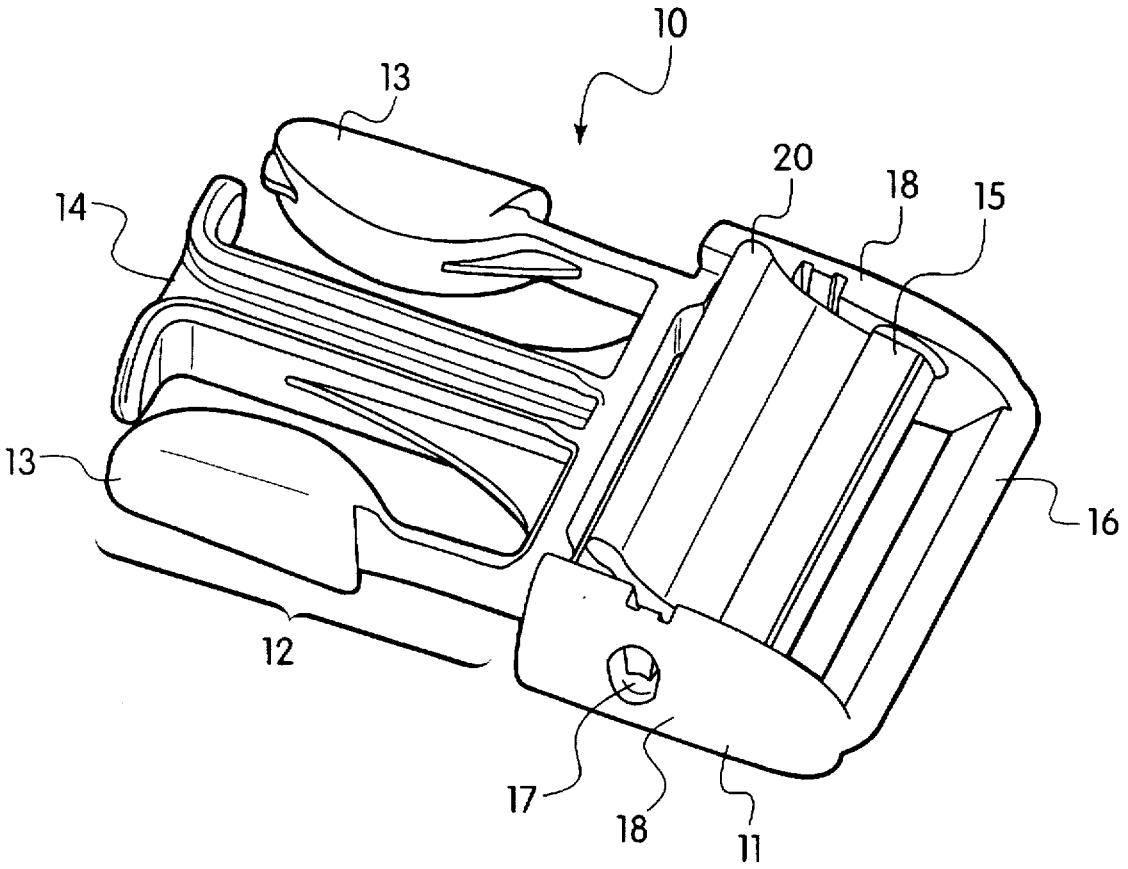
FIG. 1 is a perspective view of a first embodiment of the device according to the invention.

Referring now in detail to the drawings, and in particular FIGS. 1–6, there is shown one embodiment of the buckle according to the invention. Buckle 10 has a body 11 attached to the male locking part 12 of a side-release plug and socket type buckle assembly. Locking part 12 is comprised of center arm 14 and locking arms 13. Body 11 has two side arms 18 integrally formed with an end arm 40. A first transverse bar 30 is mounted between side arms 18 near locking part 12. A second transverse bar 15 extends between side arms 18 between first transverse bar 30 and end arm 40 to create a gap for threading a length of webbing therethrough.

Figure 2:
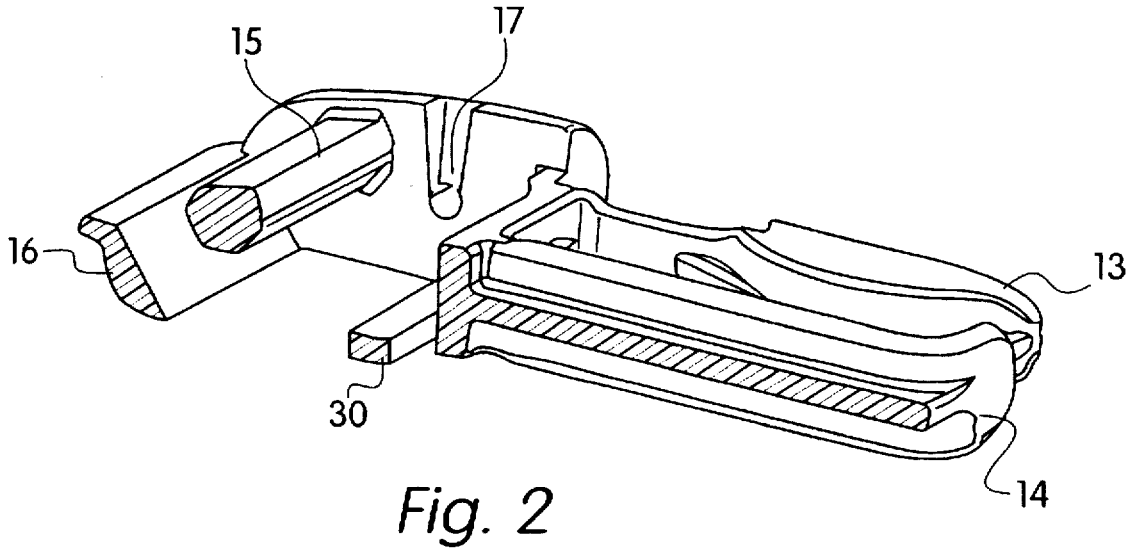
FIG. 2 is a partial perspective view of a section of the buckle body without the gripping cam.
Figure 3:
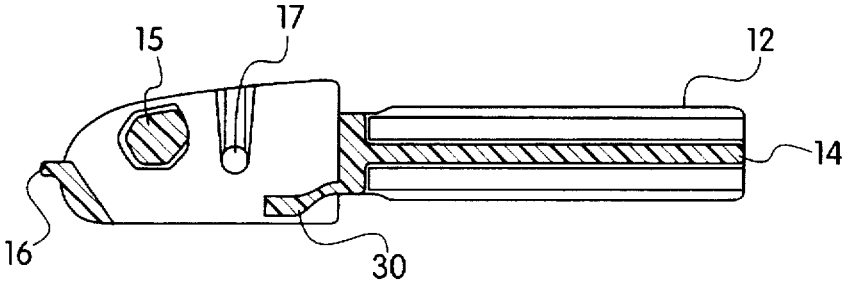
FIG. 3 is a cross sectional view of the buckle body shown in FIG. 2.
Figure 4:
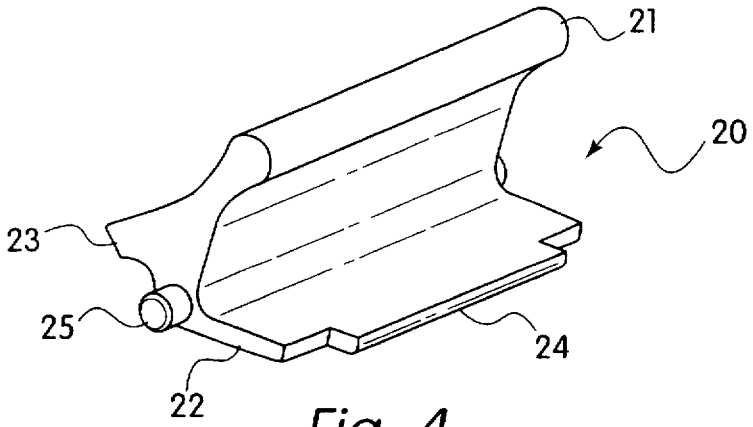
FIG. 4 is a perspective view of the gripping cam shown in FIG. 1.
Figure 5:
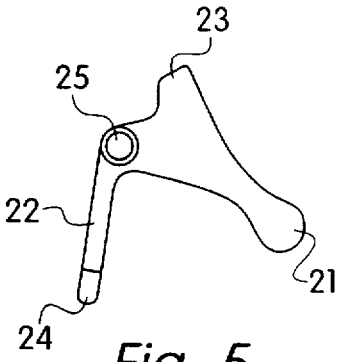
FIG. 5 is a is a side view of the gripping cam shown in of FIG. 4.
Figure 6:
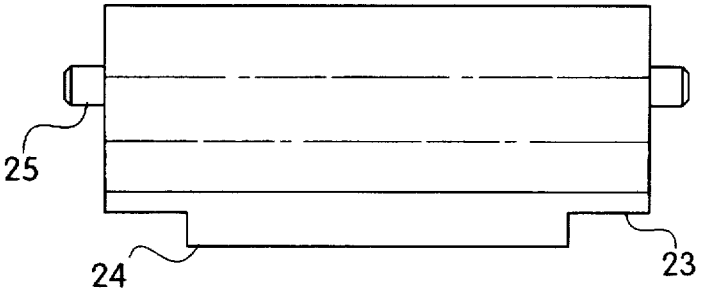
FIG. 6 is a top view of the gripping cam shown in FIG. 4.
Figure 7:
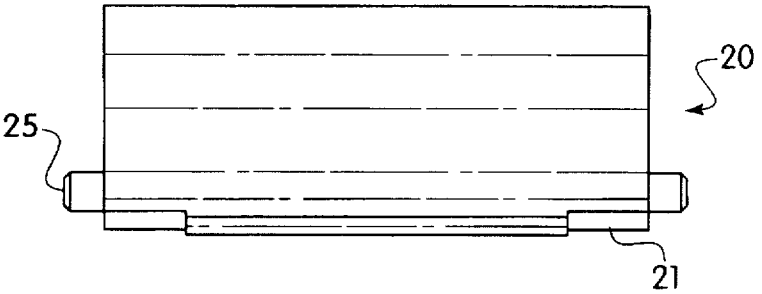
FIG. 7 is a bottom view of the gripping cam shown in FIG. 4.

As shown in FIGS. 2 and 3, second transverse bar 15 is both vertically and horizontally offset from first transverse bar 30. This arrangement allows for the simple and secure threading of webbing through bars 15 and 30.

A gripping cam 20 is pivotally mounted to body 11 via lugs 25 on cam 20 inserted through apertures 17 on side arms 18 of buckle 10. The entire structure of cam 20 is shown in FIGS. 4–7. Cam 20 has a gripping surface 23, an opposite free end 21, and a rearwardly-extending flange 22 with a center tab 24. Cam 20 is snapped into buckle 10 by inserting lugs 25 into apertures 17. In a resting position, gripping surface 23 rests firmly against second transverse bar 15 as shown in FIG. 8A to firmly grip a length of webbing threaded therethrough.

Figure 8A:
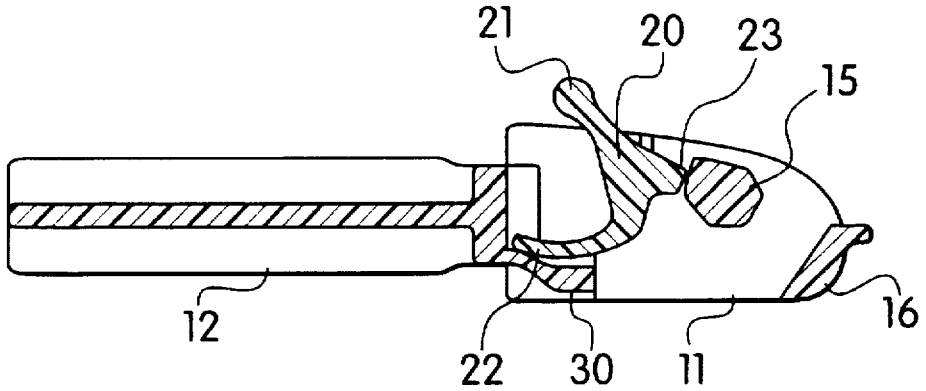
FIGS. 8A–8C are side cross sectional views of the buckle of FIG. 1, showing the sequence of the gripping cam being pressed into a release position.
Figure 8B:
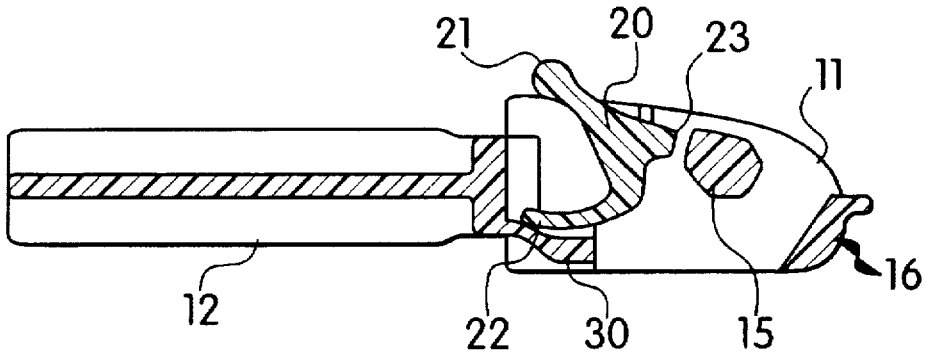
Figure 8C:
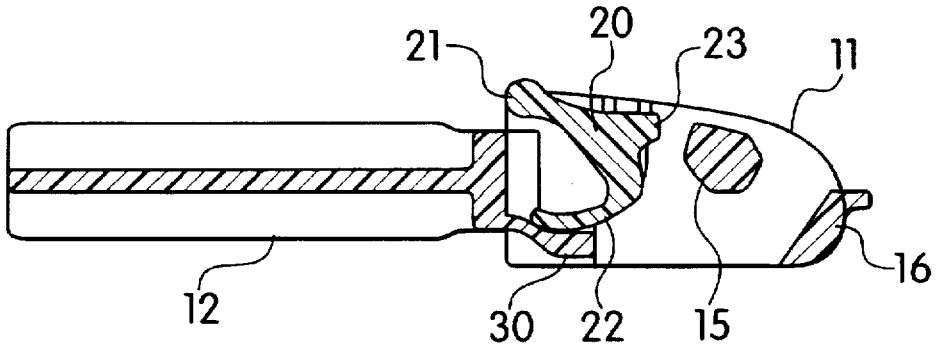
Figure 10:
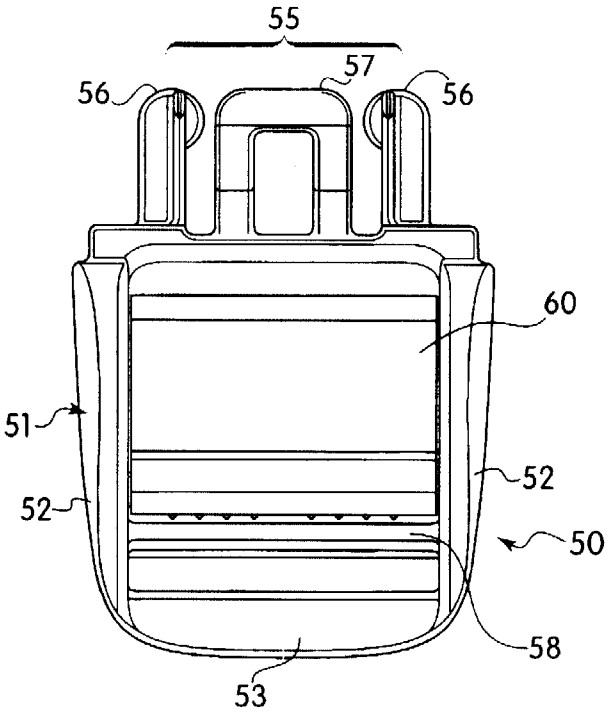
FIG. 10 is a top view of the embodiment shown in FIG. 9.

Gripping cam 20 can be moved away from second transverse bar 15 to release or adjust a length of webbing by simply pressing downward on free end 21, as shown in FIGS. 8A–8C. This causes flange 22 to bend against first transverse bar 30 and allow gripping surface 23 to pivot away from second transverse bar 15. Releasing free end 21 causes gripping cam 20 to spring back into a resting position where it is in tensioned contact with second transverse bar 15. The tensioned contact of gripping cam 20 with second transverse bar 15 is maintained by the downward pressure of flange 22 on first transverse bar 30.

The present invention is a significant improvement over the prior art, because even if the gripping cam 20 breaks, the strap is still secured in the conventional manner between the two transverse bars 15 and 30.

A second embodiment of the buckle according to the invention is shown in FIGS. 9–12. Buckle 50 has a body 51 attached to the male locking part 55 of a center push plug and socket type buckle assembly. Locking part 55 is comprised of center plate 57 and locking arms 56. Body 51 has two side arms 52 integrally formed with an end arm 53. A first transverse bar 61 is mounted between side arms 52 near locking part 55. A second transverse bar 58 extends between side arms 52 between first transverse bar 61 and end arm 53 to create a gap for threading a length of webbing therethrough.

Figure 12:
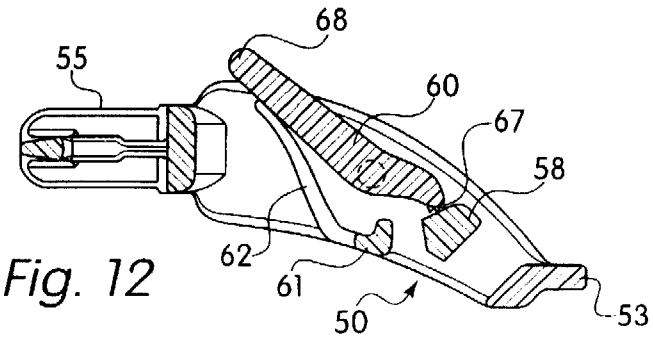
FIG. 12 is a side cross-sectional view of the embodiment shown in FIG. 9.
Figure 9:
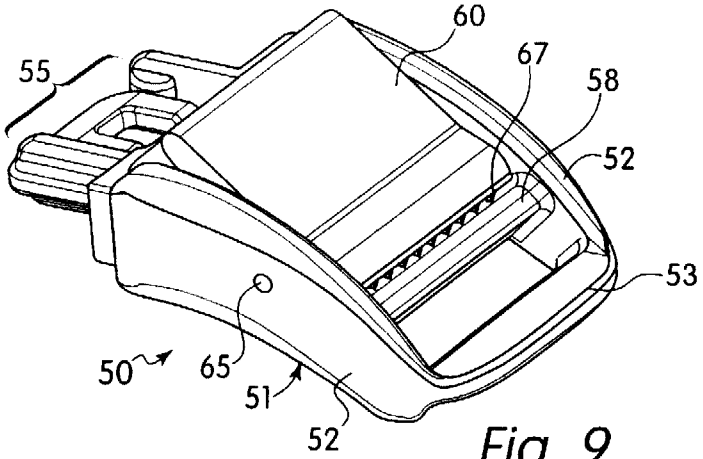
FIG. 9 is a perspective view of a second embodiment of the invention.
Figure 11:
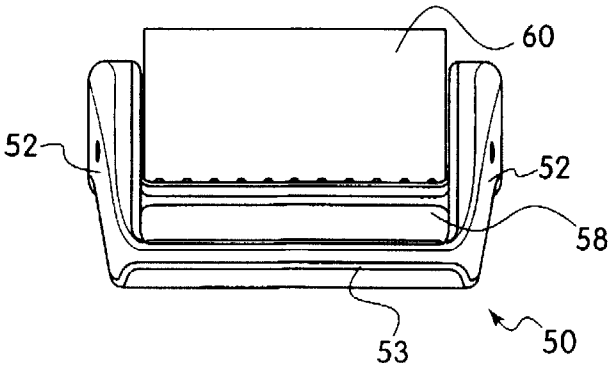
FIG. 11 is a front end view of the embodiment shown in FIG. 9.

As shown in FIG. 12, second transverse bar 58 is both vertically and horizontally offset from first transverse bar 61. This arrangement allows for the simple and secure threading of webbing through bars 61 and 58.

A gripping cam 60 is pivotally mounted to body 51 through apertures 65 on side arms 52 of buckle 50. Cam 60 has a toothed gripping surface, and an opposite free end 68. In a resting position, toothed surface 67 of cam 60 rests firmly against second transverse bar 58 as shown in FIG. 12 to firmly grip a length of webbing threaded therethrough. Cam 60 is held in tensioned contact with second transverse bar 58 by a flange 62 which is integrally formed with the first transverse bar 61 and extends upwardly and rearwardly from first transverse bar 61.

Flange 62 is resilient and supports free end 68 of gripping cam 60 to force it into contact with second transverse bar 58.

Figure 13A:
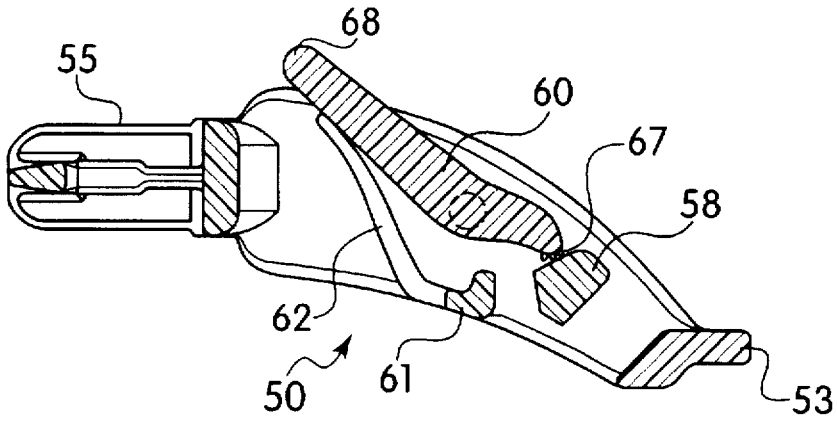
FIGS. 13A–13C show side cross-sectional views of the sequential transition between a gripping position and release position of the gripping cam on the embodiment shown in FIG. 9.
Figure 13B:
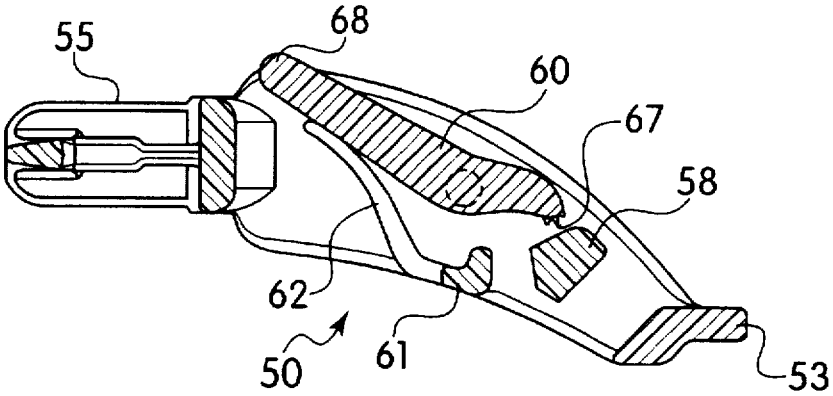
Figure 13C:
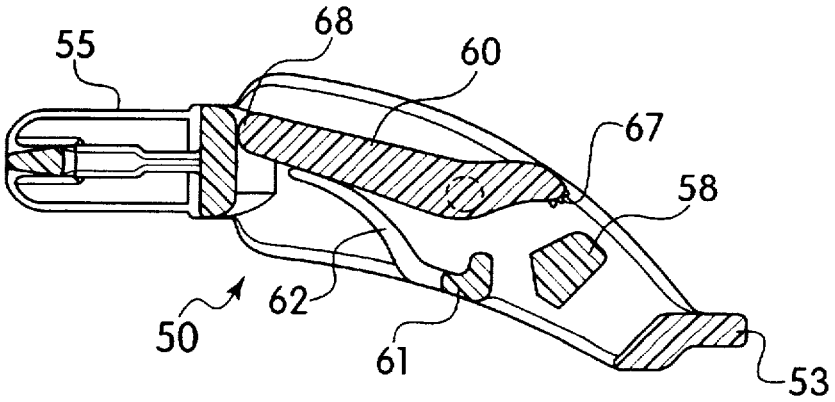

Gripping cam 60 can be moved away from second transverse bar 58 to release or adjust a length of webbing by pressing downward on free end 68, as shown in FIGS. 13A–13C. This causes flange 62 to flex downward and allow gripping surface 67 to pivot away from second transverse bar 58. Releasing free end 68 causes gripping cam 60 to spring back into a resting position where it is in tensioned contact with second transverse bar 58.

As with the first embodiment, this embodiment has the distinct advantage of the prior art that if the resilient flange breaks, the buckle still functions by holding the webbing or strap between the transverse bars in the same manner that a conventional buckle functions. The gripping cams serve as a reinforcement and not as a substitute for the transverse bars, which also serve to hold the webbing in place.

The embodiments of the present invention are easily made via injection molding. The gripping cam and buckle body could be made separately and the cam snapped into place. Alternatively, the buckle body and cam could be integrally molded in the same injection mold if there is sufficient space between the lugs on the cam and the apertures on the buckle body.

Accordingly, while only two embodiments of the present invention have been shown and described, it is obvious that many changes and modifications may be made thereunto without departing from the spirit and scope of the invention.

What is claimed is:

1. A buckle adapted for securing a length of webbing, comprising:

a buckle body comprising two side arms connected by an end arm, said side arms each having an end;

a locking portion attached to the ends of the side arms;

a first transverse bar mounted between the two side arms;

a second transverse bar mounted between the two side arms in between the first transverse bar and the end arm, said second transverse bar being disposed vertically offset from the first transverse bar;

a gripping cam pivotally mounted to the side arms and having a free end, a top surface and a bottom surface, comprising:

a gripping surface for contacting the second transverse arm, said gripping surface being located opposite said free end; and means for maintaining the gripping cam in tensioned contact with the second transverse arm;

wherein a length of webbing threaded through said transverse bars is securely held between the gripping cam and second transverse bar and is selectively released by pressing downward on the free end of the gripping cam.

2. The buckle according to claim 1, wherein the locking portion is the male portion of a plug and socket type buckle assembly.

3. The buckle according to claim 1, wherein the means for maintaining the gripping cam in tensioned contact with the second transverse bar comprises a resilient flange connected to the bottom surface of the gripping cam, said flange resting on the first transverse bar and forcing the gripping surface of the cam into contact with the second transverse bar, and wherein pressing downward on the free end of the gripping cam bends the flange and moves the gripping surface of the cam away from the second transverse bar.

4. The buckle according to claim 3, wherein the flange is L-shaped and comprises a downwardly-extending first leg connected to the bottom surface of the cam, and a rearwardly-extending second leg connected to the first leg, said second leg being thinner than said first leg and bending in response to downward pressure from the cam.

5. The buckle according to claim 1, wherein the means for maintaining tensioned contact between the gripping cam and the second transverse bar comprises a resilient flange attached to the first transverse bar, said flange contacting the bottom surface of the gripping cam and forcing the gripping cam into tensioned contact with the second transverse bar, and wherein downward pressure on the gripping cam bends the flange and moves the gripping surface of the cam away from the second transverse bar.

6. The buckle according to claim 1, wherein the gripping cam is pivotally mounted to the side arms of the buckle body by a mechanism comprising a lug on each side of the gripping cam and an aperture for receiving the lug on each of said side arms, said lugs being pivotable within the apertures.

7. The buckle according to claim 1, wherein the gripping surface has a plurality of teeth.

8. The buckle according to claim 1, wherein the second transverse bar has a planar surface facing the gripping surface of the gripping cam.

9. The buckle according to claim 1, wherein the second transverse bar has a textured gripping surface that contacts the gripping surface of the gripping cam.

10. The buckle according to claim 9, wherein the gripping surfaces of the cam and second transverse bar are grooved.

* * * * *